United States Patent [19]

Nigol

[11] Patent Number: 4,891,473

[45] Date of Patent: Jan. 2, 1990

[54] HIGH VOLTAGE INSULATORS CONSTRUCTED TO HAVE PLURAL DRY BANDS IN USE

[76] Inventor: Olaf Nigol, 272 Markland Drive, Toronto, Ontario, Canada, M9C 1R7

[21] Appl. No.: 354,717

[22] Filed: May 22, 1989

[51] Int. Cl.[4] ..... H01B 17/04; H01B 17/48

[52] U.S. Cl. ..... 174/150; 174/211

[58] Field of Search ..... 174/141 R, 141 C, 150, 174/211, 212

[56] References Cited

U.S. PATENT DOCUMENTS

| | | | |
|---|---|---|---|
| 1,768,948 | 7/1930 | Baum | 174/212 X |
| 3,819,851 | 6/1974 | Nigol | 174/211 |

FOREIGN PATENT DOCUMENTS

| | | | |
|---|---|---|---|
| 2347920 | 4/1975 | Fed. Rep. of Germany | 174/212 |
| 871851 | 1/1942 | France | 174/212 |

OTHER PUBLICATIONS

Cherney, E. A., et al., "Development and Application of a New Semiconductive-Glaze Insulator", *IEEE Transactions on Power Apparatus and Systems,* vol. PA-S-97, No. 6, Nov./Dec. 1978, pp. 2117-2126, (S9097 0068).

*Primary Examiner*—Laramie E. Askin

*Attorney, Agent, or Firm*—Ridout & Maybee

[57] ABSTRACT

The invention relates to high voltage suspension insulators of the single disc type and high voltage station post insulators consisting of unitary insulator sections. The insulator elements are designed so as to maximize the number of dry bands under adverse weather conditions thereby to maximize the total arc root resistance under arcing conditions so as to minimize the likelihood of flashover.

6 Claims, 4 Drawing Sheets

HIGH VOLTAGE INSULATORS CONSTRUCTED TO HAVE PLURAL DRY BANDS IN USE

FIELD OF THE INVENTION

This invention relates to high voltage outdoor insulators and is concerned specifically with high voltage suspension insulators of the single disc type and station post insulators, which are designed to withstand continuous operating voltages V of 60 kV or higher.

BACKGROUND OF THE INVENTION

The requirements for outdoor electrical insulation in a power system are dictated by three different types of voltage stresses produced by (1) Normal Operating and Temporary Power Frequency Overvoltages
(2) Switching Surge Voltages
(3) Lightning Surge Voltages.

The normal operating power frequency voltage stress is relatively low, but it is continuous. The temporary power frequency overvoltages are produced during abnormal operating conditions such as faults and resonances and their magnitudes and durations in high and extra high voltage systems are typically less than 2 V and 0.5 seconds, respectively. The switching surge voltages are the result of switching operations and their magnitudes and durations are typically less than 3 V and hundreds of microseconds, respectively. The lightning surge voltages can be very high, greater than 1000 kV, but are of very short duration, and they are independent of system operating voltages. Because some lightning surge voltages are very high, system apparatus designed for lower surge withstand voltages are usually protected by surge arresters. To provide some protection to high voltage overhead lines, grounded shield wires or skywires are commonly used to intercept lightning strokes, However, this method will not provide complete protection and flashovers across the insulation will still occur at a rate depending on lightning stroke current magnitudes, frequency and the insulation level of the line.

In relatively clean environments where the contamination levels on insulator surfaces are low, i.e. equivalent salt deposit density or ESDD$<$0.01 mg/cm$^2$, the insulation level to be used on high voltage lines is determined entirely by the switching surge and/or lightning surge voltages. However, in areas where insulator contamination is a problem, ESDD$>$0.01 mg/cm$^2$, the length of an insulator or an insulator string is dictated by the normal power frequency operating voltage under certain weather conditions. Experience has shown that with conventional insulators satisfactory performance under most environmental conditions can be obtained by limiting the power frequency voltage stress to less than 75 kV (rms)/meter of axial length of insulation.

In the early 1960's when extra high voltages, namely voltages above 400 kV, came into use by power utilities, the above voltage stress was increased initially to about 87 kV/m and later to about 95 kV/m for economic reasons. In early years of such high voltages the operating experience with stations and lines appeared to be satisfactory. However, as time passed and the insulator surfaces, especially the undersurfaces which are not exposed to cleaning action by rain and snow, became contaminated, both the line and station insulators started to exhibit flashovers under certain weather conditions.

Detailed laboratory and field studies have shown that insulator flashovers at normal power frequency operating voltages are the result of two basic parameters, namely, insulator surface contamination and the rate of wetting under certain weather conditions. The chemical composition of contaminants that are important in this case are all compounds that form ions in the presence of water. Some inert particles play a secondary role in the flashover process by providing sites for moisture condensation and trapping as well as in the accumulation of ionic surface contaminants. Since there are many different ionic components that are deposited on insulator surfaces in different areas, it was decided some twenty-five years ago to express the amount or the severity of contamination in terms of equivalent salt (NaCl) deposition density (ESDD) in units of mg of NaCl per square centimeter of insulator surface area (mg/cm$^2$). That means that the basic criterion is the resultant surface resistivity and not the chemical composition of the actual contaminants involved.

The exposed top surfaces of insulators and insulator shells can be wetted by rain, snow, freezing rain and by the impingement of small airborne water droplets associated with fogs and sprays on sea coasts. In the presence of wind these various types of precipitation and droplets can be deposited at some angle ($\theta$) from the vertical. Studies have shown that this angle can be as high as 45° for water droplets depending on the wind speed and the droplet size and even higher, say 70°, for snowflakes. From this it is apparent that the top surfaces of relatively open shaped conventional suspension and station post insulators will become completely wet or snow and ice covered and contribute very little to the electrical strength of the insulator. Therefore, practically all the electrical strength of conventional insulators under these conditions resides in the sheltered bottom surfaces.

Laboratory and field studies have shown that the sheltered bottom surfaces of insulators can be wetted only by one particular process, and that is moisture condensation, with one exception. On sea coasts in very high winds fine water spray can in some cases also wet the bottom surfaces of insulators. However, in the great majority of cases the insulator flashovers occur during a set of weather conditions in which the principal mechanism of surface wetting is condensation.

In order for water vapour present in the air to condense out on insulator surfaces, or to appear as visible cloud or fog, the temperature of the insulator surface ($T_s$) and the ambient air ($T_a$) necessarily must be lower than the dew point temperature ($T_s<T_d$, $T_a<T_d$), respectively. When these temperatures are equal, the air is saturated with water vapour and the relative humidity (RH) equals 100%. The rate at which the vapour will condense out on a surface is proportional to the temperature difference $T_d-T_s$. Condensation on insulator surfaces under natural conditions requires that a warm air mass at a relatively high relative humidity should mix with a colder air mass so as to produce saturated conditions $T_a=T_d$ and then to move to the colder region. This would result in a condition $T_s<(T_a=T_d)$ because the insulator would always lag behind the ambient temperature due to its thermal mass and time constant. If the movement of the mixed zone is in the opposite direction, i.e. $T_s>(T_a=T_d)$, no condensation would occur on insulator surfaces, although fog may be present in both cases. This is consistent with all the insulator flashovers and observations in fogs, during early morning dew and with some special conditions following freezing rain and wet snow near $T_a=0°$ C.

When the above condition, i.e. $T_s<(T_a=T_d)$, occurs following freezing rain or wet snow ($T_a<0°$ C.), the condensation process is enhanced because the insulator temperature remains at $T_s=0°$ C. until the ice or snow melts. If $T_a$ or $T_d$ rises several degrees above $T_s=0°$ C., the rapid rate of condensation and severe wetting of all insulator surfaces will occur and as a result this particular condition becomes the most critical requirement in the design and performance of insulators at normal frequency operating voltages.

The flashover mechanism of contaminated and wet insulators and its importance on insulator performance and design can be best described by the relationships between the applied voltage V, leakage resistance R(x), arc voltage and the resultant leakage current I. Before any dry bands are formed $$V=I\,R(x)$$

For a typical single disc insulator the leakage resistance of the contaminated and wet surface between the cap and pin is $R(x)\simeq 40{,}000$ ohms even at very low contamination levels of ESDD≃0.01 mg/cm². With a typical applied voltage of 10 kV, the leakage current is I=250 milliamperes and the $I^2R(x)$ loss 2500 watts. Due to the surface geometry, most of this loss is concentrated around the pin area because the current density is highest in that region. With the amount of heat involved the moisture around the pin area is evaporated very quickly and a dry band is formed. If the resultant dry band is wide enough, the leakage current will cease, surface will cool, condensation will recur and the process may be repeated many times. If the dry band width x is insufficient to support the applied voltage, it will arc over and the arc voltage must be included in the above equation $$V = I\,R(x) + \frac{60x}{\sqrt{I}}$$

For the arcing to continue with an alternating voltage applied, the re-ignition of the arc in consecutive half-cycles requires that $$V > \frac{400\,x}{\sqrt{I}}$$

Based on the above equations it has been postulated that as the dry bands widen R(x) will decrease, the current I will increase and a flashover will occur when the dry band width x reaches a critical length. The experimental data of current in terms of applied voltage, surface resistance and arc voltage have never supported this simple postulate. What has been observed is that the leakage current drops from its initial value of several hundred milliamperes (ma) to less than 10 ma once a dry band and arc is formed. This indicates the presence of a high resistance which is not explained by the above equations. The reason and the effect of this high resistance on the design and performance of all outdoor high voltage insulators are very important.

Recent studies made by the applicant have shown that the apparent resistance of the wet surface layer R(x) after a dry band has been formed consists of two components, namely, the arc root resistance $R_a$ and the resistance of the remaining conductive layer $R_x$. The arc root resistance, which is the resistance of the wet surface layer around the arc root, is by far the larger component of the total resistance and therefore will limit the current and control the flashover process.

This discovery by applicant of high arc root resistance, and the recognition that there can be only one arc and one or two arc roots at any time across a dry band, is of major importance in high voltage insulator design. When a dry band forms around a metal cap or pin, there is only one arc root that terminates on the insulator surface, When a dry band forms on an insulator surface, there are two arc roots.

SUMMARY OF THE INVENTION

It is an object of the present invention to take advantage of the above-mentioned discovery by increasing the number of dry bands on insulators of the types referred to, thereby to increase the electrical strength per unit axial length of such insulators at continuous operating voltages and temporary power frequency overvoltages under all practical environmental conditions.

According to one aspect of the present invention, there is provided a high voltage suspension insulator of the single disc type adapted to withstand a continuous operating voltage of at least 60 kV, comprising a vertical string of axially aligned petticoats, each petticoat having an annular rim and upper and lower non-conductive surfaces which slope uninterruptedly downwardly and outwardly to the rim, wherein the configuration and spacing of the petticoats are such that the upper petticoat of each adjacent pair shrouds a predetermined area of surface of the adjacent lower petticoat lying within an inverted cone of cone angle $2\theta$, where $90°\leqq 2\theta \leqq 140°$, which intersects the rim of the upper petticoat, and wherein the minimum air clearance between the rim of each petticoat and the next unshrouded area of the insulator is at least 100 mm.

According to another aspect of the invention, there is provided a high voltage station post type insulator adapted to withstand a continuous operating voltage of at least 60 kV, comprising an assembly of vertically aligned interconnected insulator units, each unit having a plurality of axially spaced annular skirts, and each skirt having an annular rim and upper and lower non-conductive surfaces which slope uninterruptedly downwardly and outwardly to the rim, wherein the configuration and spacing of the skirts are such that the upper skirt of each adjacent pair shrouds a predetermined area of surface of the lower skirt lying within an inverted cone of cone angle $2\theta$, where $90°\leqq 2\theta \leqq 140°$, which intersects the rim of the upper skirt, and wherein the minimum air clearance between the rim of each major skirt and the next unshrouded area of the insulator is at least 100 mm.

BRIEF DESCRIPTION OF THE DRAWINGS

In the accompanying drawings, which illustrate exemplary embodiments of the invention.

DESCRIPTION OF THE PREFERRED EMBODIMENTS

It should first be stressed that, as a practical matter, the benefits of the invention are to be gained only with outdoor high voltage glass or porcelain insulators of high mechanical strength. Specifically, these comprise transmission line suspension insulators of the single disc type arranged in a string to withstand continuous operating voltages of 60 kV or higher and having a mechanical strength of 15,000 lbs. tension or higher, and large station post insulators consisting of single sections with metal flanges, the latter also being designed to withstand continuous operating voltages of 60 kV or higher and typically having a mechanical strength greater than 1,000 lbs. cantilever and 15,000 lbs. tension or higher. At lower distribution voltages the leakage distances of insulators are so large that dry bands and arcs do not usually form, or if they do form, it is the leakage resistance $R_x$ rather than the arc root resistance $R_a$ that dominates. The requirement of high mechanical strength can be met in the case of suspension insulators of the single disc type, but it is not physically possible to meet the requirement in multi-disc designs where the discs are cemented together or otherwise jointed. Similarly, the mechanical strength requirement in the case of station post insulators can only be met where the insulator sections are unitary sections with metal flanges; the requirement rules out other designs.

Figure 1:
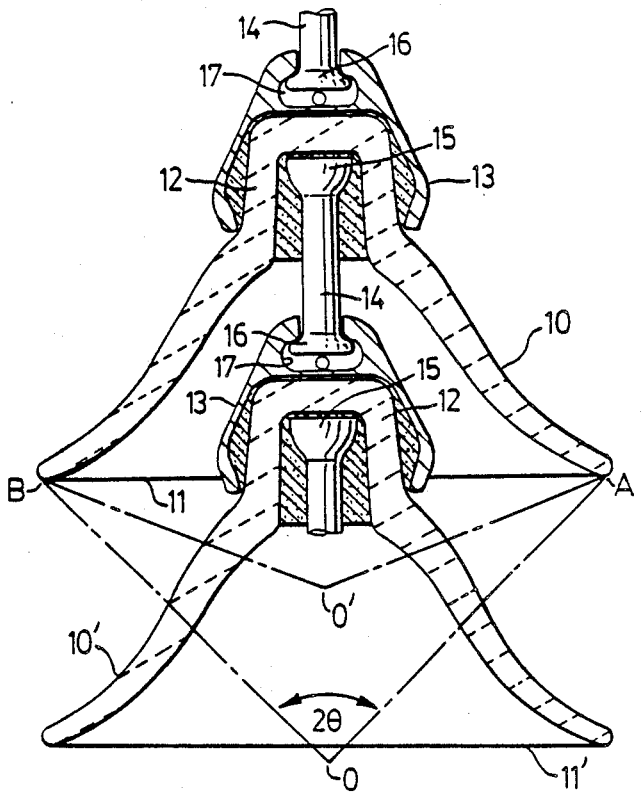
FIG. 1 is a half-sectional elevational view showing part of a suspension insulator according to the invention.

FIG. 1 shows part of a high voltage transmission line suspension insulator of the single disc type, the insulator comprising a string of axially aligned petticoats or discs which are interconnected by cap and pin joints. Only two petticoats 10, 10' are shown in FIG. 1. Each of the petticoats 10, 10' comprises a downwardly depending, bell-shaped, glass or porcelain body, providing an annular rim 11, 11' and upper and lower surfaces which slope uninterruptedly downwardly and outwardly from a central head portion 12 to the rim. It is most important that these surfaces slope down to the rims 11, 11' without interruption, that is to say, without pockets or valleys in which contamination and moisture could accumulate.

A metal cap 13 is cemented to the head portion 12 of each petticoat. The petticoats are interconnected by axially extending metal pins 14, the enlarged upper end 15 of each pin being cemented within a well formed interiorly of the head portion 12. The lower end of each pin 14 is provided with an enlarged portion 16 which engages in a socket 17 provided by the metal cap 13 of the adjacent lower insulator petticoat. With this well known cap and pin design, the glass or porcelain in the head is placed in compression, thus resulting in high mechanical strength.

Each of the bell-shaped petticoats of the insulator string shrouds a predetermined area of the surface of the insulator structure so as to shield that area from driving rain, freezing rain and snow. Thus, referring to FIG. 1, the upper petticoat 10 can be considered to shroud all surfaces, including a predetermined area of the upper surface of the lower petticoat 10', so as to shield them from rain, freezing rain or snow driving at an angle $\theta$ to the vertical. The shielded area is that which lies within an inverted cone AOB or AO'B of cone angle $2\theta$ which intersects the rim 11 of the petticoat 10 and is coaxial with it. In high wind conditions the angle $\theta$ may be as high as 70°, and to meet such conditions, the configuration and spacing of the petticoats must be such that the upper petticoat 10 of each adjacent pair shrouds a predetermined area of the upper surface of the lower petticoat 10' lying within an inverted cone of cone angle $2\theta=140°$ which intersects the rim of the upper petticoat. However, in environments where less extreme conditions are encountered, the configuration and spacing of the petticoats can be such that the protected area will lie within a cone of smaller angle. For example, if rain, freezing rain or snow is not expected to drive at an angle greater than 45° to the vertical, the shielded area of the lower petticoat of each adjacent pair will be that which lies within an inverted right-angled cone which intersects the rim of the upper petticoat and is coaxial with it. In that case the shrouded area will remain unwetted from rain, freezing rain or snow falling in any direction at an angle not greater than 45° to the vertical.

It is important to note that the configuration described provides two dry bands between each pair of wetted surfaces of the insulator. One dry band is provided by the inner surface of the upper petticoat 10, and the other is provided by the shrouded part of the outer surface of the lower petticoat 10'. As a consequence, the flashover mechanism will involve two arcs and two arc roots per petticoat, thus greatly increasing the resistance to flashover as compared with conventional designs, which involve only one arc and one arc root.

It is important, of course, that the spacing between the petticoats should be sufficient to prevent direct flashover of the insulator in rain due to partial water bridging of air between wetted surfaces. It is found in practice that the minimum air clearance, that is to say, the minimum distance from the rim of each petticoat to the next wetted surface, should be at least 100 mm.

Figure 2:
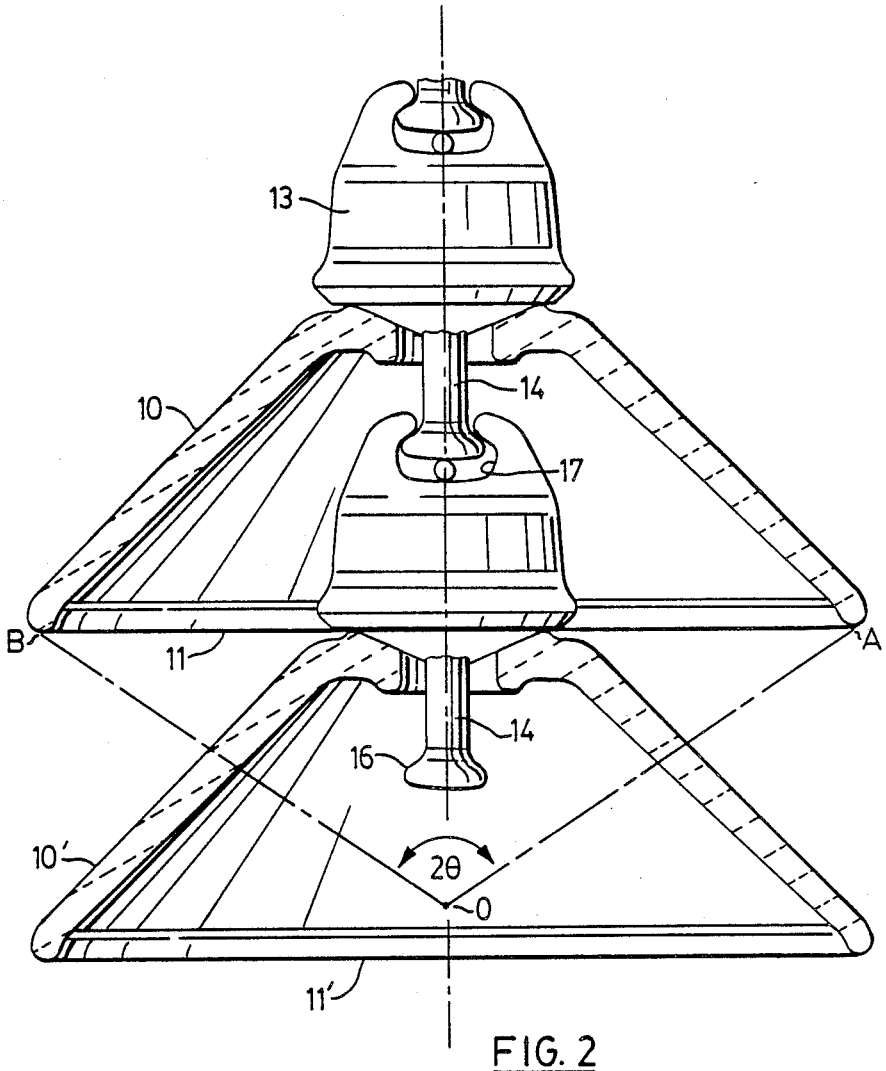
FIG. 2 is a half-sectional elevational view showing part of a second suspension insulator according to the invention.

In an alternative insulator design the petticoats are cone-shaped rather than bell-shaped. FIG. 2 shows part of such an insulator, which is identical in all other respects with the insulator of FIG. 1, corresponding parts being denoted by the same reference numerals. As shown in FIG. 2, the upper petticoat 10 shrouds a predetermined area of the upper surface of the lower petticoat 10' lying within an inverted cone of cone angle $2\theta$ which intersects the rim 11 of the upper petticoat, the shrouded area being that which remains unwetted from rain falling in any direction at an angle $\theta$ to the vertical. As in the preceding embodiment of the invention, the spacing and configuration of the petticoats is such that the angle $\theta$ lies between 45° and 70° to suit the given environment. As in the preceding embodiment, the insulator ensures that the flashover mechanism will include two arcs per petticoat, thus greatly increasing the total arc root resistance and so inhibiting flashover.

Figure 3:
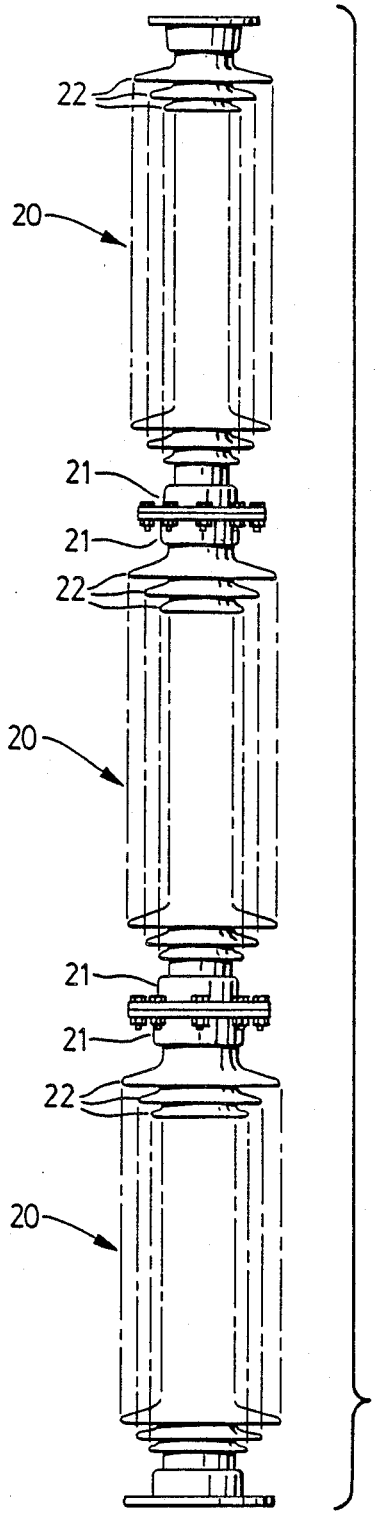
FIG. 3 is an elevational view showing part of a station post insulator.

FIG. 3 illustrates part of a station post insulator according to the present invention. The insulator consists of a plurality of unitary insulator sections 20, of glass or porcelain, with metal end flanges 21 by which they are interconnected end to end. Such an insulator, being adapted to withstand continuous operating voltages of 60 kV or higher, must be of high mechanical strength and typically must withstand a cantilever load of 1,000 lbs. or a tensile load of 10,000 lbs.

Each of the insulator sections 20 is formed with annular skirts 22 distributed along its length. These skirts are configured and spaced in a particular manner as will now be described with particular reference to FIG. 4.

Figure 4:
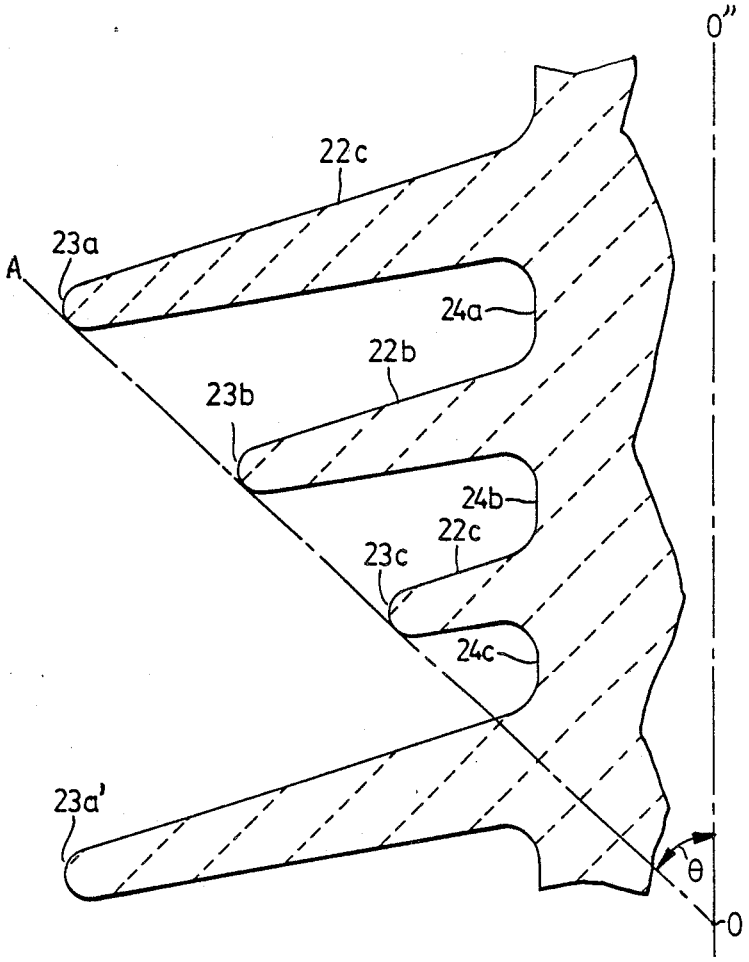
FIG. 4 is an enlarged sectional view showing a detail of FIG. 3.

Referring to FIG. 4, the skirts 22 are arranged in a recurring pattern of three skirts 22*a*, 22*b*, 22*c*, and the rims 23*a*, 23*b*, 23*c* of the skirts define an inverted cone of angle $2\theta$ as shown in the figure, where the line O—O″ denotes the axis of the insulator and OA denotes the envelope of the cone. Each of the skirts has upper and lower surfaces which slope uninterruptedly downwardly and outwardly to its rim, thus providing an easy run-off for condensed moisture. The angle $\theta$ is chosen to lie between 45° and 70°, depending on the environment in which the insulator will be used. Thus, each of the skirts shrouds a predetermined area of the adjacent lower skirt with respect to rain falling at an angle $\theta$ to the vertical. As in the receding embodiments described, the minimum air clearance from the rim 23*a* of each major skirt 22*a* to the rim 23*a*′ of the next major skirt must be at least 100 mm.

It should be noted that in this case each skirt provides one dry band at its base, 24*a*, 24*b*, 24*c*, and two arc roots and resistances because both ends of the arc terminate on the insulator surface. Therefore, each recurring pattern of three skirts 22*a*, 22*b* and 22*c* will provide a total of six arc root resistances. In contrast, conventional station post insulators will provide only one dry band and two arc root resistances for the same 100 mm air clearance between two consecutive skirts.

I claim:

1. An outdoor high voltage glass or porcelain suspension insulator of the single disc type adapted to withstand a continuous operating voltage of at least 60 kV, comprising a vertical string of axially aligned petticoats, each petticoat having an annular rim and upper and lower non-conductive surfaces which slope uninterruptedly downwardly and outwardly to the rim, wherein the configuration and spacing of the petticoats are such that the upper petticoat of each adjacent pair shrouds a predetermined area of surface of the adjacent lower petticoat lying within an inverted cone of cone angle $2\theta$, where $90° \leqq 2\theta \leqq 140°$, which intersects the rim of the upper petticoat, and wherein the minimum air clearance between the rim of each petticoat and the next unshrouded area of the insulator is at least 100 mm.

2. An outdoor high voltage glass or porcelain suspension insulator according to claim 1, wherein the configuration and spacing of the petticoats are such that the upper petticoat of each adjacent pair shrouds a predetermined area of surface of the adjacent lower petticoat lying within an inverted right-angled cone which intersects the rim of the upper petticoat.

3. An outdoor high voltage glass or porcelain suspension insulator according to claim 1, wherein the petticoats are bell-shaped.

4. An outdoor high voltage glass or porcelain suspension insulator according to claim 1, wherein the petticoats are cone-shaped.

5. An outdoor high voltage glass or porcelain insulator of the station post type adapted to withstand a continuous operating voltage of at least 60 kV, comprising an assembly of vertically aligned interconnected insulator units, each unit having a plurality of axially spaced annular skirts arranged in sets forming a recurring pattern, each set comprising an uppermost skirt and a plurality of lower skirts axially aligned therewith, and each skirt having an annular rim and upper and lower non-conductive surfaces which slope uninterruptedly downwardly and outwardly to the rim, wherein the configuration and spacing of the skirts are such that the upper skirt of each adjacent pair shrouds a predetermined area of surface of the adjacent lower skirt lying within an inverted cone of cone angle $2\theta$, where $90° \leqq 2\theta \leqq 140°$, which intersects the rim of the upper skirt, and wherein the minimum air clearance between the rim of each said uppermost skirt and the next unshrouded area of the insulator is at least 100 mm.

6. An outdoor high voltage glass or porcelain insulator according to claim 5, wherein the configuration and spacing of the skirts are such that the upper skirt of each adjacent pair shrouds a predetermined area of surface of the adjacent lower skirt lying within an inverted right-angled cone which intersects the rim of the upper skirt.

* * * * *